US005207425A

United States Patent [19]

Cohrs

[11] Patent Number: 5,207,425

[45] Date of Patent: May 4, 1993

[54] DEVICE FOR HANDLING GAME PIECES

[76] Inventor: Kenneth O. Cohrs, 155 Branford Rd., North Branford, Conn. 06471

[21] Appl. No.: 663,080

[22] Filed: Feb. 28, 1991

Related U.S. Application Data

[63] Continuation-in-part of Ser. No. 532,867, Jun. 4, 1990, abandoned.

[51] Int. Cl.[5] ..... A63F 9/00

[52] U.S. Cl. ..... 273/148 R; 141/332; 141/337

[58] Field of Search ..... 273/148 R; 141/332-343; 138/162, 158, 166

[56] References Cited

U.S. PATENT DOCUMENTS

| | | | |
|---|---|---|---|
| 435,638 | 9/1890 | Barnes | 141/341 |
| 1,578,554 | 3/1926 | Seligman . | |
| 2,073,914 | 3/1937 | Wilfley | 141/337 X |
| 2,100,888 | 11/1937 | Vine | 141/337 |
| 2,699,336 | 1/1955 | Keim | 273/136 |
| 2,814,493 | 11/1957 | Keim | 273/148 |
| 3,347,276 | 10/1967 | Dunn | 138/166 |
| 3,750,722 | 8/1973 | Nowak | 141/332 X |
| 3,804,134 | 4/1974 | Wehking | 141/337 X |
| 3,844,337 | 10/1974 | Bessett et al. | 141/337 X |
| 4,479,651 | 10/1984 | LaFleur | 273/157 |
| 4,552,361 | 11/1985 | LaFleur | 273/157 |
| 4,667,702 | 5/1987 | Roth | 138/162 |
| 4,919,426 | 4/1990 | Vieira | 273/148 R |

FOREIGN PATENT DOCUMENTS

| | | | |
|---|---|---|---|
| 3705 | of 1907 | United Kingdom | 141/337 |
| 149574 | 8/1920 | United Kingdom | 141/337 |

*Primary Examiner*—Paul E. Shapiro
*Attorney, Agent, or Firm*—CTC & Associates

[57] ABSTRACT

A device for handling game pieces is assembled from four uniform elements and when assembled includes a base portion that will fit over a game board and a chimney portion of sufficiently large internal size to permit passage by gravity of game pieces therethrough from the game board and into a bag that is placeable over the chimney portion. The device in one form is of plastic and in another form is of cardboard and is such that it is flat when disassembled to be packageable with a particular game.

7 Claims, 8 Drawing Sheets

DEVICE FOR HANDLING GAME PIECES

This is a continuation in part of application Ser. No. 07/532,867 filed on Jun. 4, 1990 herewith abandoned.

BACKGROUND OF THE INVENTION

The device of this invention may broadly be useable to assist in the removal and return of any board game pieces from the playing board to their storage container. However, its dimensions and shape are such that its primary use is for game boards wherein the playing pieces fit into indents in the game board surface; thus the pieces cannot be swept or brushed from the game board surface but must be individually picked up to be removed from the game board. Alternatively, the game board could be inverted over for example a table spilling the playing pieces onto the table, then swept or brushed into their storage container. This alternative almost invariably results in lost playing pieces and chaos for those next playing the game. One such game is sold under the registered Trademark SCRABBLE wherein there are many alphabetic playing pieces and a playing board with indents (deluxe version) into which the playing pieces are placed during play. The time to individually pick up the pieces after a game may seem minor but in fact is an irritant to dedicated players, particularly in tournament play. This invention facilitates the collective removal of alphabetic playing pieces from the Scrabble board and return of the same to their storage container. preliminary search for patentability revealed the following U.S. patents:

| U.S. Pat. No. | Date | Inventor |
|---|---|---|
| 1,578,554 | March 30, 1926 | Seligman |
| 2,699,336 | January 11, 1955 | Keim |
| 2,814,493 | November 26, 1957 | Keim |
| 4,479,651 | October 30, 1984 | LaFleur |
| 4,552,361 | November 12, 1985 | LaFleur |

The patents found in the search relate to various means for handling game pieces or tiles. However, none of the patents appears to teach or suggest the structure or manner of use of the present invention.

| | | |
|---|---|---|
| 4,919,426 | April 24, 1990 | Vieira |

Vieira discloses a one piece dust cover for a game board which provides a corner opening in its top through which the game pieces are removed when the game board and cover are joined and inverted.

In addition to the above, examination of the original U.S. application Ser. No. 07/532,8867, filed on Jun. 4, 1990, revealed the following Patents:

| | | |
|---|---|---|
| U.S. Pat. No. 435,638 | September 1890 | Barnes |
| U.S. Pat. No. 2,073,914 | March 16, 1937 | Wilfley |
| U.S. Pat. No. 2,100,888 | November 30, 1937 | Vine |
| U.S. Pat. No. 3,750,722 | August 7, 1973 | Nowak |
| UK 149,574 | August 19, 1920 | Smith |

The above named patents deal with industrial funnels of one type or another, none of which singularly disclose the use or combination of features of the instant invention.

The principal object of the present invention is to provide a device which saves time in handling game pieces at the conclusion of play, to increase playing time.

Another object of the invention is to provide such a device which is low cost and easily used and stored.

A further object of the invention is to provide such a device that is readily assembled into its useful form.

A still further object of the invention is to provide such a device that when disassembled is capable of being efficiently packaged with a game or separately in a flat package.

The manner in which the invention attains the foregoing objects and advantages will appear hereinafter.

SUMMARY OF THE INVENTION

A device for handling game pieces is assembled by interrelating four uniform elements. It includes a rectangular or square prism base portion that fits over a game board and a acute truncated pyramid chimney portion of sufficiently large internal size to permit passage by gravity of game pieces therethrough from the game board and into a bag or other container that is placeable over the chimney portion. The device in one form is of plastic and is intended for almost limitless multiple assembling/disassembling and in another lower cost form is of cardboard with a limited capability for multiple assembly/disassembly and may be considered as a promotional item.

DESCRIPTION OF THE INVENTION

Figure 1:
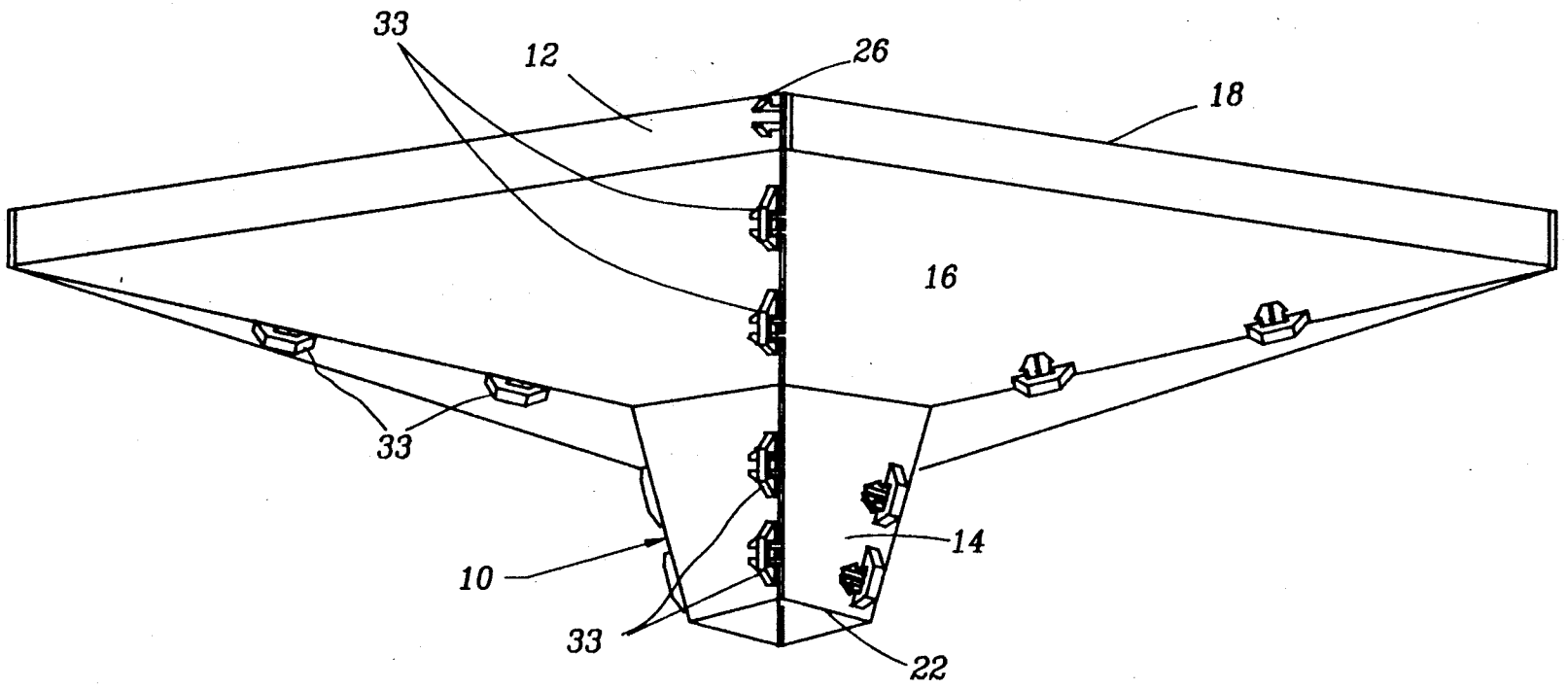
FIG. 1 is a perspective upward view of an assembled game piece handling device that is a preferred embodiment of the invention.

The drawing shows in multiple views a hollow game piece handling device 10 that in one multiple assembly/disassembly form may be of injection molded of suitable semirigid modestly flexible plastic such as polypropylene, polyethylene, compounded PVC, elastomer modified polystyrene and the like. Alternatively hollow game piece handling device 10 in a limited assembly/disassembly form may be of steel die died cardboard.

Device 10 (FIGS. 1 and 2) is assembled by interrelating four elements 20. As assembled, device includes at one axial end a base portion 12 and at the other axial end a square truncated pyramid chimney 14. The square defined by chimney portion 14 is substantially smaller than that defined by base portion 12. Base portion 12 and chimney portion 14 are joined by a central portion 16 in the form of a second truncated four-sided pyramid, the four sides of which are identical, being inclined at an obtuse angle with respect to base portion 12. Portions 12, 14 and 16 are coaxial.

Figure 2:
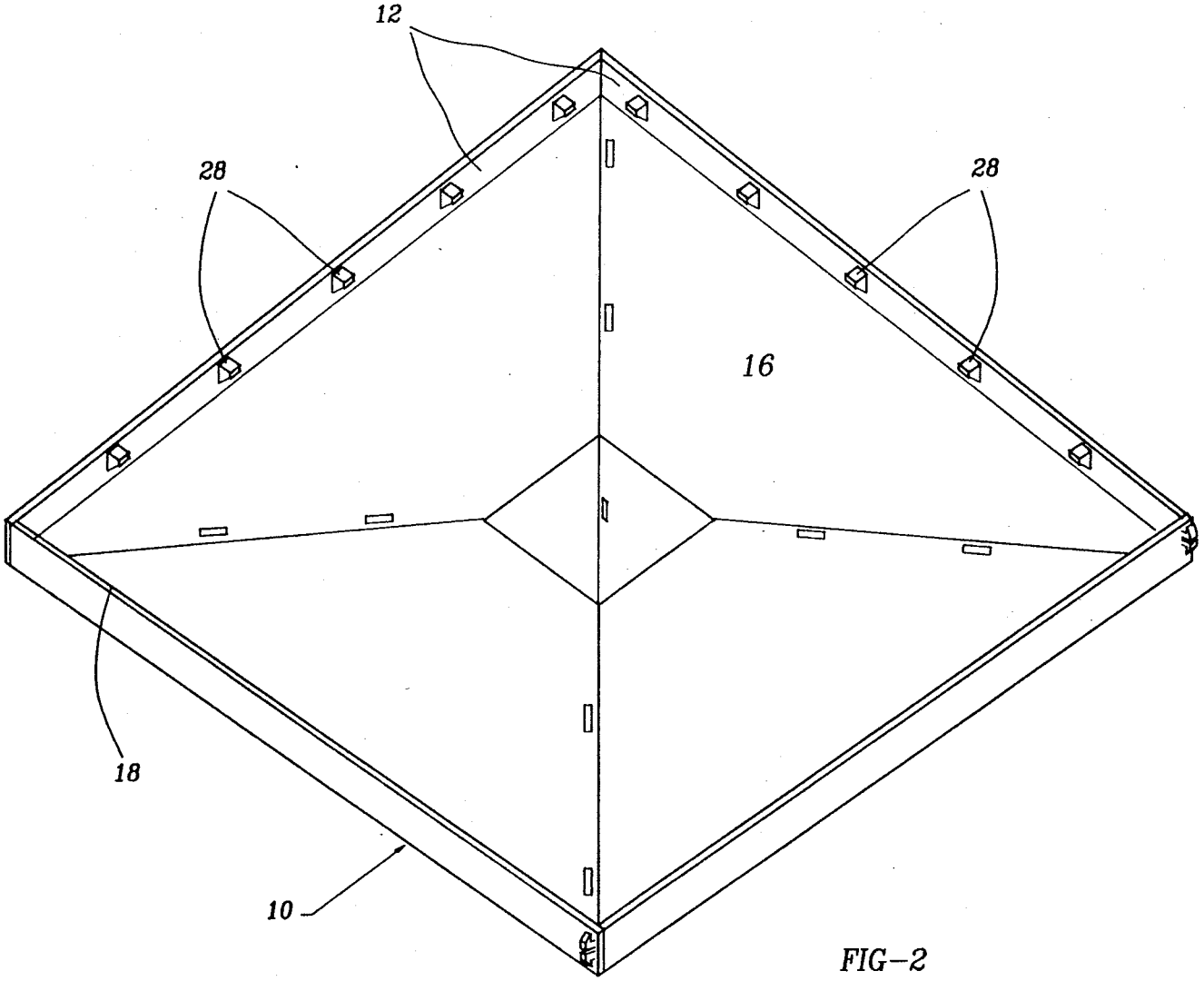
FIG. 2 is a perspective downward view of the same device.
Figure 3:
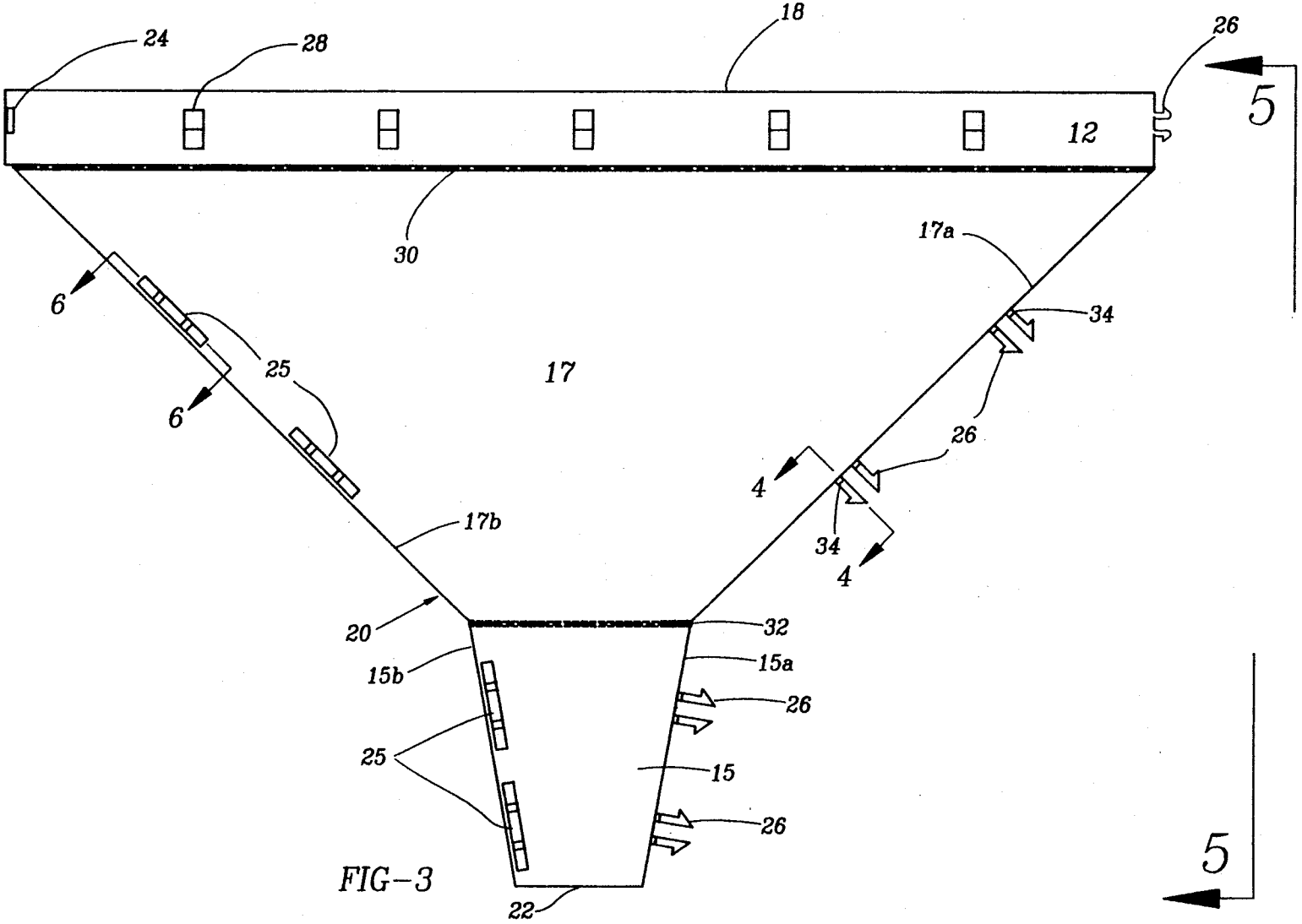
FIG. 3 is a plan view of one of four elements which when assembled form the instant device.

Base portion 12 (FIG. 3) plan view of one of four elements 20 which when interrelated form device 10 and terminates in a plane 18 perpendicular to the axis of single element 20. Chimney portion 14 terminates in plane 22 perpendicular to the axis of single element 20. When four single elements 20 are interrelated each element relates to the others so that the planes of base 12 and of chimney 14 are in the same relationship. Base portion 12 and chimney portion of single element (FIG. 3) and when assembled (FIGS. 1 and 2) are slightly tapered in the direction such that they become closer to the axis as one proceeds from plane 18 towards plane 22.

Figure 6:
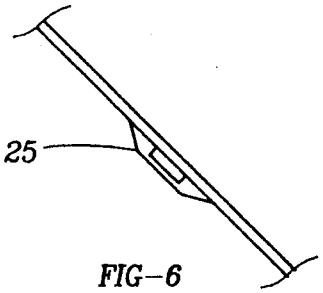
FIG. 6 is a side view of a locking clipway along line 6—6.
Figure 4:
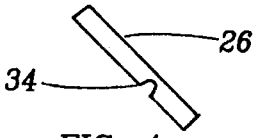
FIG. 4 is a side view of the springy locking clip shown in 4—4 of FIG. 3.
Figure 7:
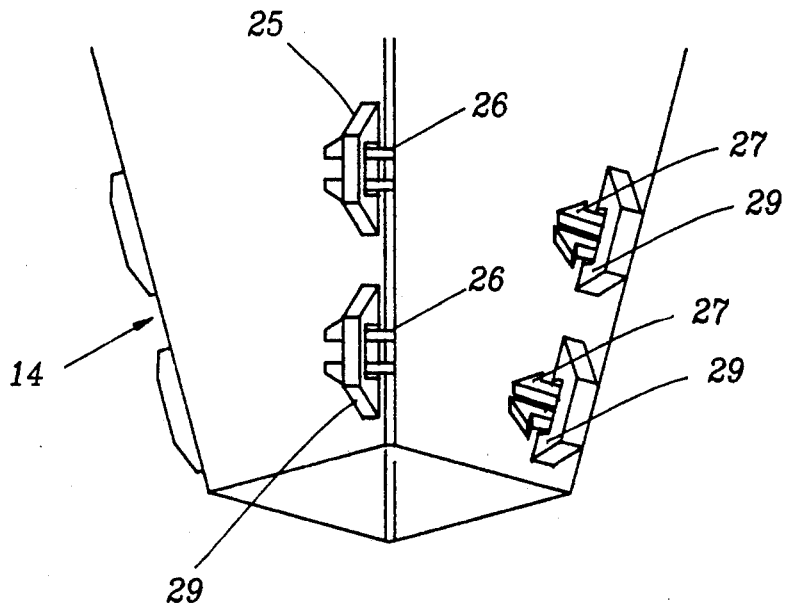
FIG. 7 is a perspective assembled view of the chimney portion illustrating the locking mechanism of interlocked springy locking member and locking clipways.

Individual element 20 having a rectangular base 12 (FIG. 3), at one end 26 a locking clip, having at its opposing end a clipway 24 into which locking clip 26 of an adjacent second element is interrelated. Base 12 also has a number of bosses 28 extending above its surface which when assembled to form device 10 act as a standoff to support a game board and prevent it from falling into device 10. The upper border 30 of base 12 is undercut and forms a well known living hinge to permit unlimited flexing from the flat when folded to an obtuse angle in relationship to central portion 17 when assembled. Portion 18 of single element 20 has at one side 17 of the truncated triangle or obtuse trapezoid formed by upper border 30, sides 17*a* and 17*b* and lower border 32. Two locking clips 26 and at its other side 17*b*. Two locking clipways to accept locking clips 26 during assembly. Clipway 24 is shown in detail in FIG. 6 illustrating that clipway 24 is formed on the underside of single element 20. Locking clips 26 have an undercut at their respective bases 34. AS shown in side view of one component of locking clip 26 in FIG. 4 forming a living hinge.

Truncated triangle or acute trapezoid 15 forming one side of chimney 14 when assembled has as its base undercut 32 to form a living hinge to permit the flexing of side 15 in relationship to side 17 when being assembled into device 10. Sides 15*a* and 15*b* form the sides of triangle 15 and terminate in line 22. Two locking clips 26 extend from side 15*a*. Two locking clipways 24 are extended from the underside of side 15*b*. The clipways and locking clips engaging another single element 20 in the assembly of device 10.

Figure 5:
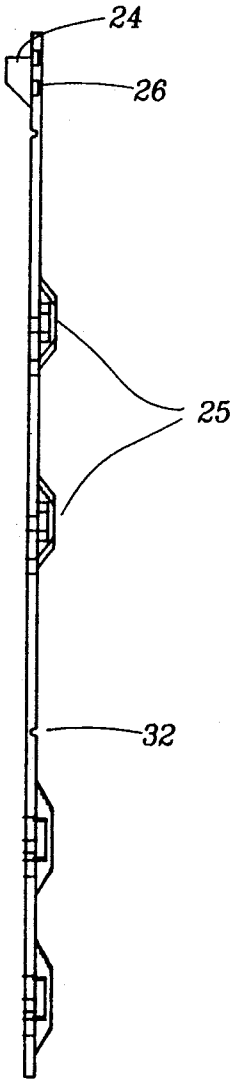
FIG. 5 is a side view of the locking clipway along line 5—5 of FIG. 3.

FIG. 5 illustrates the location of clipways 24 along line 5—5 of FIG. 1. Clipway 24 extend on the upper or inner side while clipway 25 extends on the underside of single element 20.

Locking clipways 25 and locking clips 26 when interrelated and locked by deflecting both barbs 27 of locking clips toward each other, passing the deflected locking clips through locking clipways, releasing both clips so that barbs 27 extend beyond land 29 of locking clipway. Separation of locked clipways and locking clips is accomplished by deflecting barbs 27 toward each other so that they no longer extend beyond land 29 and passing the deflected clips through the clipways in the reverse direction. All assembled and locked clipways and clips 33 are located on the outside of device 10 so as not to block the flow of the game pieces from the playing board.

Figure 8:
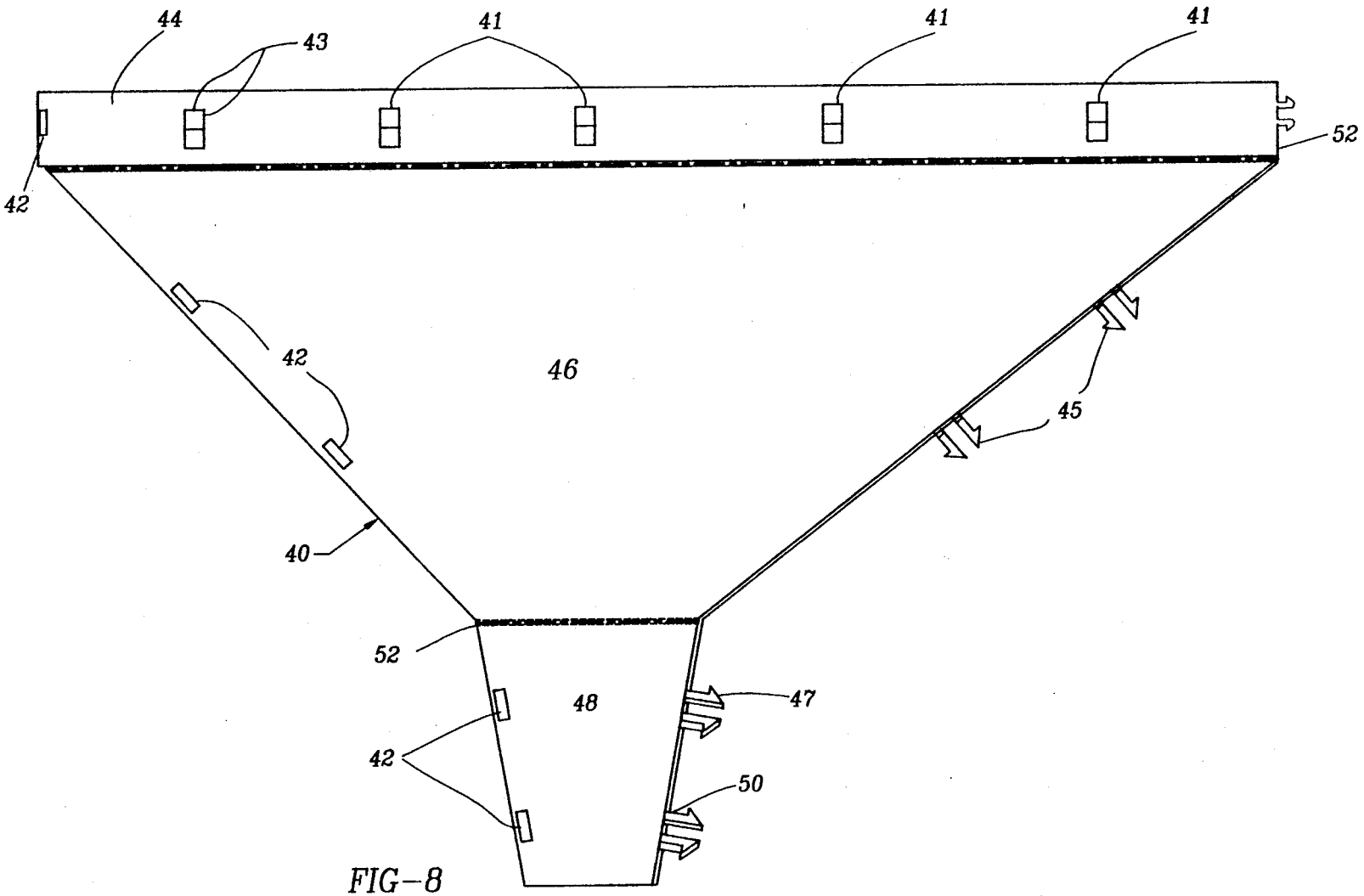
FIG. 8 is a perspective view of a single element as formed in cardboard.
Figure 9:
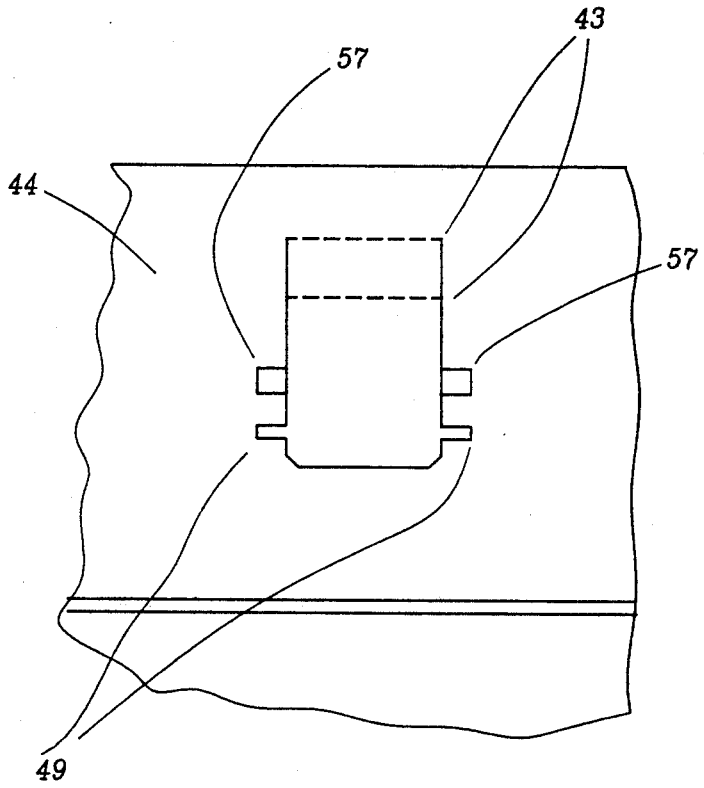
FIG. 9 is a perspective view of a standoff as formed in cardboard.
Figure 9A:
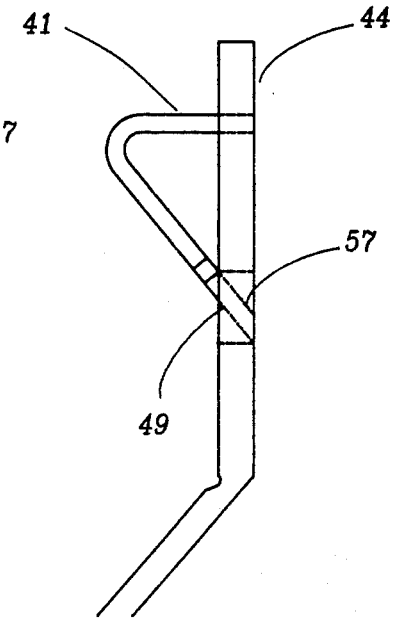

Cardboard version of device 10 is made up of four uniform elements 40 as shown in FIG. 8 is died or stamped from a cardboard sheet. The relationship of each individual element 40 is the same as plastic single element 20 which interrelate to form the same configuration of device 10. The major difference is that rectangular locking clipways 42 are stamped into one end of base 44 and truncated triangles 46 and 48. Standoffs 41 are formed by cutting on three sides and adding crease lines 43 forming a tab which can be bent into a triangle the FIG. 9, 9*a* top side of which remains attached to base 44 the bottom of the box extending through and locking into base 44 with tabs 49 locking into cutouts 57. Locking clips 45 have barbs 47, crease lines are stamped into locking clips 45 at the base so that they will readily bend when interlocked during assembly into device 10. Crease lines 52 are also stamped in at base 44 and at the junction of truncated triangle 46 and 48. When folded and flexed into interrelating relationship with three other single elements 40 and locked with locking clips 45 passing through rectangular locking clipways 42 device 10 is formed.

Figure 10:
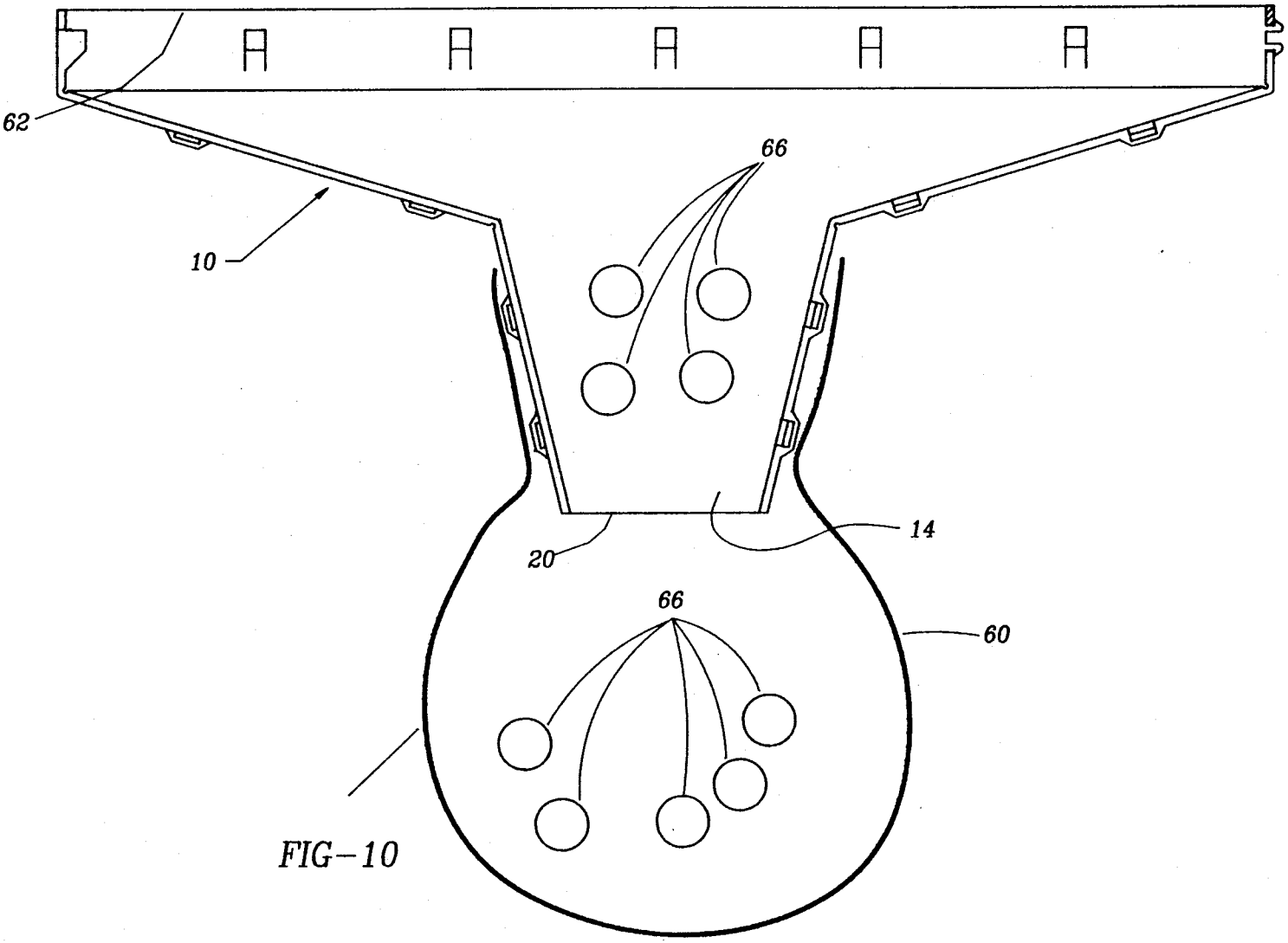
FIG. 10 is a cutaway view of the device of the instant invention showing the passage of game pieces into a receptacle.

Cutaway FIG. 10 shows a bag 60 having its open end secured over chimney portion of device 10 with game pieces 66 in the process of falling from game board 62 into bag 60 for storage or dispensing for another game.

It is apparent that the invention well attains the stated objects and advantages among others.

The disclosed details are exemplary only and are not to be taken as limitations on the invention except as those details may be included in the appended claims.

What is claimed is:

1. A unitary device for handling game pieces comprising four uniform one piece elements, each of said four elements having rectangular base portion, an obtuse trapezoidal central portion and an acute trapezoidal chimney portion, each of said elements having at one side a number of locking clips and at the other side a number of clipways, said locking clips being spaced to interrelate and interlock with said clipways of the other of said uniform elements; when said four elements are interrelated and interlocked with each other said unitary device for handling game pieces is formed.

2. The formed unitary device of claim 1 wherein each of said four one piece elements interrelate and interlock to form a rectangular prisim base, a truncated obtuse prisim center portion and an acute truncated prisim chimney, said rectangular prisim base fitting over a game board said truncated obtuse center portion and said acute truncated prisim chimney portion acting in concert to receive said game pieces, when said device is placed over said game board and simultaneously inverted, said game pieces flowing into and through said device into a container placed to receive said game pieces.

3. The formed unitary device according to claim 1 wherein the said locking clips have two barbed portions which are deflected toward each other when said barbed portions pass through said related clipways, said clipways having a land onto which said barbed portions rest when said clips have passed through said clipways to lock to the other said uniform elements to form said unitary device.

4. The formed unitary device according to claim 3 which is easily disassembled for storage wherein said two barbed portions of said locking clips are deflected toward each other until said barbed portions clear said clipways land, applying pressure to said deflected barbed portions of said locking clips to force the same through said clipways thus unlocking said interrelated interlocked uniform elements which formed said unitary device.

5. Four one piece elements of claim 1 wherein said elements are molded of plastics which have the ability to form living hinges, such plastics being selected form the group of plastics consisting of polypropylene, polypropylene co polymers, polyethylene, compounded PVC and elastomer modified polystyrene said group of plastics being molded in the flat form having undercuts molded into said elements at the intersection of said base portion and said central portion and at the intersection of said central portion and said chimney portion and the base of said locking clips to ease the flexing and bending of said elements during the forming of said unitary device.

6. A unitary device of claim 1 wherein said rectangular prisim base portion has bosses molded therein to act as standoffs onto which a game board rests to prevent said game board from falling into said device.

7. Four one piece elements of claim 1 wherein said elements are die cut of cardboard in the flat form, said die cut elements having creased lines stamped into said flat cardboard at the intersection of said base portion and said central portion and at the intersection of said central portion and chimney portion to ease bending of said cardboard flat form in relating and locking of said four elements to form said unitary device.

* * * * *